US009194127B2

(12) United States Patent
Atchley

(10) Patent No.: US 9,194,127 B2
(45) Date of Patent: Nov. 24, 2015

(54) ROOF RIDGE COVER

(71) Applicant: Mitch Atchley, Yorba Linda, CA (US)

(72) Inventor: Mitch Atchley, Yorba Linda, CA (US)

( * ) Notice: Subject to any disclaimer, the term of this patent is extended or adjusted under 35 U.S.C. 154(b) by 0 days.

(21) Appl. No.: 13/660,926

(22) Filed: Oct. 25, 2012

(65) Prior Publication Data

US 2013/0042540 A1 Feb. 21, 2013

Related U.S. Application Data

(63) Continuation-in-part of application No. 29/377,116, filed on Oct. 18, 2010, now Pat. No. Des. 656,248.

(60) Provisional application No. 61/552,084, filed on Oct. 27, 2011.

(51) Int. Cl.

| | |
|---|---|
| ***E04D 1/30*** | (2006.01) |
| ***E04D 1/34*** | (2006.01) |
| ***E04D 13/17*** | (2006.01) |
| ***E04D 1/26*** | (2006.01) |
| *E04D 1/00* | (2006.01) |

(52) U.S. Cl.

CPC *E04D 1/265* (2013.01); *E04D 1/30* (2013.01); *E04D 1/3402* (2013.01); *E04D 13/174* (2013.01); *E04D 2001/005* (2013.01); *E04D 2001/305* (2013.01)

(58) Field of Classification Search

CPC ..... E04D 1/30; E04D 2001/35; E04D 13/174; E04D 1/3402; E04D 3/362; F24F 7/02

USPC ..... 52/57, 198, 199, 276, 278, 287.1, 52/288.1, 518–560

See application file for complete search history.

(56) References Cited

U.S. PATENT DOCUMENTS

| | | | | | |
|---|---|---|---|---|---|
| 1,470,054 | A | | 10/1923 | Broughton | |
| 1,653,847 | A | | 12/1927 | Greenstreet | |
| 1,861,998 | A | | 6/1932 | Bennett | |
| 1,963,583 | A | | 6/1934 | Jenkins | |
| 2,160,642 | A | | 5/1939 | Bumpas et al. | |
| 2,230,922 | A | * | 2/1941 | Young | 52/276 |
| 2,255,247 | A | * | 9/1941 | Gabriel | 52/278 |
| 2,360,052 | A | * | 10/1944 | Fuller | 52/276 |
| 2,386,338 | A | * | 10/1945 | Norrid | 52/276 |
| 2,725,832 | A | | 12/1955 | Huntington | |
| 3,073,235 | A | | 1/1963 | Smith et al. | |
| 3,114,218 | A | | 12/1963 | Macquere | |
| 3,164,929 | A | * | 1/1965 | Boddie | 52/409 |
| 3,731,438 | A | | 5/1973 | Kough | |
| 3,760,546 | A | | 9/1973 | Martin et al. | |

(Continued)

*Primary Examiner* — Ryan Kwiecinski

(74) *Attorney, Agent, or Firm* — Kirk A. Buhler; Buhler & Associates

(57) ABSTRACT

Improvements in a roof ridge cover formed to give the appearance of multiple shingles. The roof ridge cover is fabricates with bend radius to ensure that the base material is not stretched beyond the yield point of the material where it can rupture or split. The edges wrap around existing roof tiles to cover any damaged tiles and provide sufficient clearance of adjacent or abutting ridge covers. The cover is stone coated to provide similar appearance to the roof surface. The stone coatings provide surface protection, wear resistance and provide a gripping surface for installers or others that may walk on the roof surface. Optional venting material may be used under the cover to allow air to vent from the attic thereby allowing the attic to breath, but the vent must also be sufficiently dense enough to prevent insects and bugs from passing through the vent material.

17 Claims, 4 Drawing Sheets

(56) References Cited

U.S. PATENT DOCUMENTS

| | | | | | |
|---|---|---|---|---|---|
| 3,953,946 | A | | 5/1976 | Peters et al. | |
| 4,015,374 | A | * | 4/1977 | Epstein et al. | 52/57 |
| 4,015,391 | A | | 4/1977 | Epstein et al. | |
| 4,024,685 | A | | 5/1977 | Aarons | |
| 4,322,924 | A | | 4/1982 | Cooper | |
| 4,400,217 | A | * | 8/1983 | Kober | 106/611 |
| 4,554,862 | A | | 11/1985 | Wolfert | |
| 4,676,147 | A | * | 6/1987 | Mankowski | 454/365 |
| 4,685,265 | A | | 8/1987 | Cooper | |
| 4,788,801 | A | | 12/1988 | Jones | |
| 5,295,340 | A | * | 3/1994 | Collins | 52/518 |
| 5,304,095 | A | * | 4/1994 | Morris | 454/365 |
| 5,352,154 | A | * | 10/1994 | Rotter et al. | 454/365 |
| 5,469,680 | A | * | 11/1995 | Hunt | 52/520 |
| 5,561,953 | A | * | 10/1996 | Rotter | 52/198 |
| 5,613,337 | A | * | 3/1997 | Plath et al. | 52/533 |
| 5,636,490 | A | | 6/1997 | Stocksieker | |
| 5,881,501 | A | | 3/1999 | Guffey | |
| 6,351,913 | B1 | * | 3/2002 | Freiborg et al. | 52/57 |
| 8,245,482 | B2 | * | 8/2012 | Grubka et al. | 52/748.1 |
| 2001/0032421 | A1 | * | 10/2001 | Rotter | 52/198 |
| 2002/0095882 | A1 | * | 7/2002 | Rotter | 52/199 |
| 2004/0206012 | A1 | * | 10/2004 | Pressutti et al. | 52/57 |
| 2005/0055902 | A1 | * | 3/2005 | Pressutti et al. | 52/198 |
| 2010/0218433 | A1 | * | 9/2010 | Quaranta et al. | 52/57 |
| 2011/0214378 | A1 | * | 9/2011 | Grubka et al. | 52/553 |
| 2012/0096782 | A1 | * | 4/2012 | Railkar et al. | 52/198 |

* cited by examiner

ROOF RIDGE COVER

CROSS REFERENCE TO RELATED APPLICATION

This application is a continuation-in-part of applicant's application Ser. No. 29/377,116 filed Oct. 18, 2010, and application Ser. No. 29/385,747 filed Feb. 18, 2011 and provisional application 61/552,084 filed Oct. 27, 2011 the entire contents of which is hereby expressly incorporated by reference herein.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

This invention relates to improvements in a roofing ridge cover. More particularly, the present invention is for an elongated formed roof ridge that covers multiple existing roof ridge tiles making installation more efficient. The ridge cover provides coverage for a plurality of shingles and wraps at least partially around the shingles to prevent leakage. The ridge cover is formed from a metal base that is stone coated to match existing shingles.

2. Description of Related Art Including Information Disclosed Under 37 CFR 1.97 and 1.98

The ridge of a roof is one area of a roof that can deteriorate the fastest. This area of a roof is usually subjected to the full sunlight, rain and wind. All of these factors can significantly shorten the life of the ridge cap. A typical ridge cap is fabricated from several layers of roofing felt that are bonded together and then covered with small sand, stones or gravel. Because this area is one of the first parts that fail water can enter into a house from the ridge cap. Installing or replacing the ridge cap with a metal cap often results in a significantly different appearance from the surrounding roof material. Some solutions have been to install individual bent shingles resulting in the existence of openings around each shingle and significant labor to install the ridge cover. Several products and patents have been filed and issued on products that try to solve this problem. Exemplary examples of patents covering these products are disclosed herein.

U.S. Pat. No. 6,725,609 that issued on Apr. 27, 2004 to Mark Freiborg et al. and published application 2010/0275542 both disclose ridge or hip covers that simulate a single shingle. They are both formed from a flat blank that is formed along the edges and then bent in the middle to simulate the ridge or hip. Because of the simple bends that are made the parts can be slightly re-bent to accommodate varied angular ridges or hips. This patent is not metal and therefore it is not painted and does not have rust protection. These parts are then simply rust protected and or painted to match the color of the roof without any additional coatings. These patents only cover a single shingle, have limited wrap to cover existing shingles and they are embedded in the mat with asphalt and are not coated to simulate stone coated shingles.

U.S. Publication Number 2006/0154597 was published on Jul. 13, 2006 and issued as U.S. Pat. No. 7,422,520 on Sep. 9, 2008 to Michael S. Coulton et al. and discloses an integrated vent that is bonded or captured under the top shingle material. The vent material extends essentially across the full width of the shingle where it can interfere with material or obstructions that extend from the base roof or ridge. This patent does not allow for coverage over shingled roofs where the roof ridge is stepped. This patent further does not disclose a stepped shingle or shingles. This patent further requires the rolled material to then be covered in the field when it is being installed.

U.S. Pat. No. 4,015,374 issued on Apr. 5, 1977 to George Epstein et al., and discloses an angled cap member for simulated cedar shake construction. The cap member is formed from a flat sheet of material and requires an elevated spacer that raises the cap above the roof. The cap is then screwed or bonded to the elevating member. The sheet metal is embossed to form simulated grain. This patent does not disclose sand, stone or gravel to simulate a shingle roof. It also does not have rounded reliefs that allow the cap to wrap around existing shingles.

U.S. Pat. No. 7,108,495 issued on Sep. 19, 2006 to Thomas Gilbert et al., discloses an apparatus for continuous forming shaped polymeric articles. The polymeric articles simulate the appearance of shake shingles arranged in rows or horizontal shingles. After the polymeric articles are formed they are surface treated to improve the wearability of the surface. While this patent is for creating the appearance of shingles. The shape is not stone coated nor is it useful for the roof ridge over shingles.

What is needed is a formed ridge cap where the cap is formed with sufficient fillets and rounds to prevent ripping of the shingle material. The ridge cap should provide coverage for multiple shingles and further be stone coated to simulate the appearance of a shingle ridge cap. These features are disclosed in this document herein.

BRIEF SUMMARY OF THE INVENTION

It is an object of the roof ridge cover to be formed to give the appearance of multiple shingles. Fabricating the roof ridge with multiple panels reduces the number of ridge shingles that must be installed at a time. This ensures consistent spacing of the shingles and makes the ridge roof more secure on a roof because a larger quantity of nails or fasteners that are used to secure the roof ridge. This further provides a significant reduction in the number of locations where water can protrude into the roof of a house or building.

It is an object of the roof ridge cover to be fabricated with bend radius using fillets and rounds to ensure that the base material is not stretched beyond the yield point of the material where it can rupture or split. A fine balance must be maintained to ensure that the bends and forming radius both cover any existing tiles, provides the appearance of shingles and is manufacturable. If the ridge cover is too long the length can be cut down or shortened using existing tools that are used by roofing installers.

It is an object of the roof ridge cover for the edges of the cover to wrap around any existing roof tiles. The wrapping edges must be sufficient to cover any damaged tiles and provide sufficient clearance of adjacent or abutting ridge covers. The wrap edges must also be short enough to prevent the ridge cover to dig into other shingles or be raised above the surrounding area.

It is an object of the roof cover to be configurable for installation on hips, gables and rakes as well as 90 degree "L" shapes. The cover is not affected by climate nor have climate restrictions for installation.

It is another object of the roof ridge cover for the top surface of the cover to be stone coated. The stone coating provides a nearly identical appearance to the remainder of the roof surface. The stone coatings provide surface protection, wear resistance and provide a gripping surface for installers or others that may walk on the roof surface.

It is still another object of the roof ridge cover to be available with a vent that is bonded to the underside of the roofing ridge cover. The vent material is sufficiently porous to allow air to vent from the attic thereby allowing the attic to breath, but the vent must also be sufficiently dense enough to prevent insects and bugs from passing through the vent material. The vent material is glued, set or otherwise placed as one or two strips on the length and optionally the ends of the cover to reduce the amount of force that is required to firmly anchor the cover onto the roof ridge.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

DETAILED DESCRIPTION OF THE INVENTION

Figure 1:
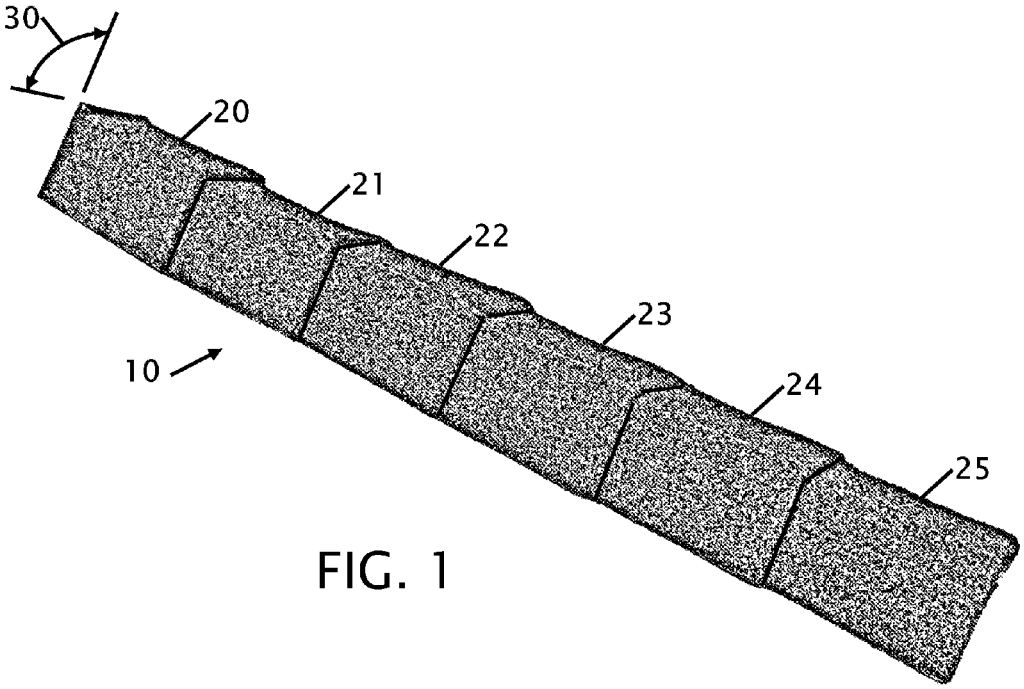
FIG. 1 shows a perspective view of a roof ridge cover.
Figure 2:
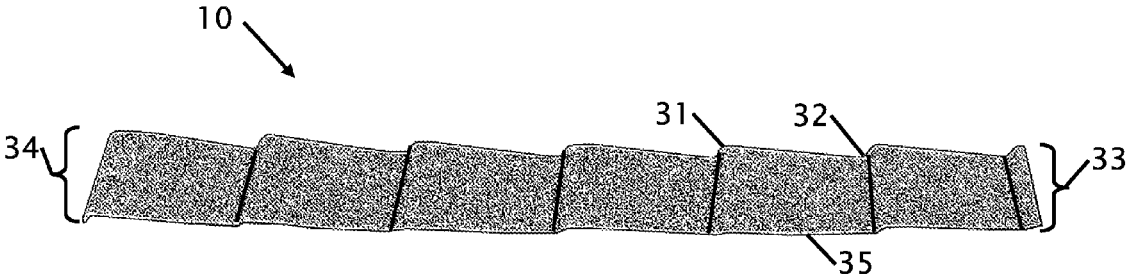
FIG. 2 shows a side view of the roof ridge cover.

FIG. 1 shows a perspective view of a roof ridge cover and FIG. 2 shows a side view of the roof ridge cover 10. The roof ridge cover 10 is fabricated to simulate the appearance of multiple ridge shingles. The steps between shingles is normally about 8 inches, but typically can vary between seven and 12 inches. The preferred embodiment shown represents steps of six levels 20-25 of ridge tiles. While six levels are shown it should be understood that as few as two to many more than six levels are contemplated. In the embodiment shown, six levels are shown because it best accommodates a four foot long blank and allows easy handling by an installer. If the end of the roof ridge cover 10 extends beyond the end of a roof, the roof ridge cover 10 can be trimmed using common roofing tools.

The angle 30 of the two sloped sides of the roof ridge cover 10 is configured to match the angle of the roof peak ridge. The angle is typically 7 or 12, but can be other angles. It is also contemplated that the cover is configurable for installation on hips, gables and rakes as well as 90 degree "L" shapes. The fabrication process allows an installer to adjust this angle by nailing down the roof ridge cover 10 or manually distorting the roof ridge cover 10 to fit an existing roof ridge. The coverage of multiple pre-existing roof tiles minimizes areas where water intrusion can take place. The bends of the roof ridge cover 10 shown as rounds 31 and fillets 32 are designed to simulate the appearance of the underlying tiles and also prevent ripping the material that might cause holes. In the preferred embodiment the rounds 31 and fillets 32 are between 0.12 radius and 1.0 radius. In addition to the bends that clear the underlying shingles the leading edge 34 and the trailing edge 33 are radiused to wrap around the front and back edges to the roof ridge cover 10. Adjacent roof ridge cover 10 ends 33 and 34 engage upon the turned up 33 or turned down edges 34 to make a tight seal. The bottom edge 35 can be configured in a straight embodiment or can further be rounded to wrap around existing ridge tiles to prevent leakage. The dimension(s) of the radiused edges are maintained to prevent damage to flat roof tiles and reduce the elevation of the roof ridge cover 10 above the surrounding roof. Installation of the roof ridge cover 10 on a roof is shown in FIG. 3.

Figure 3:
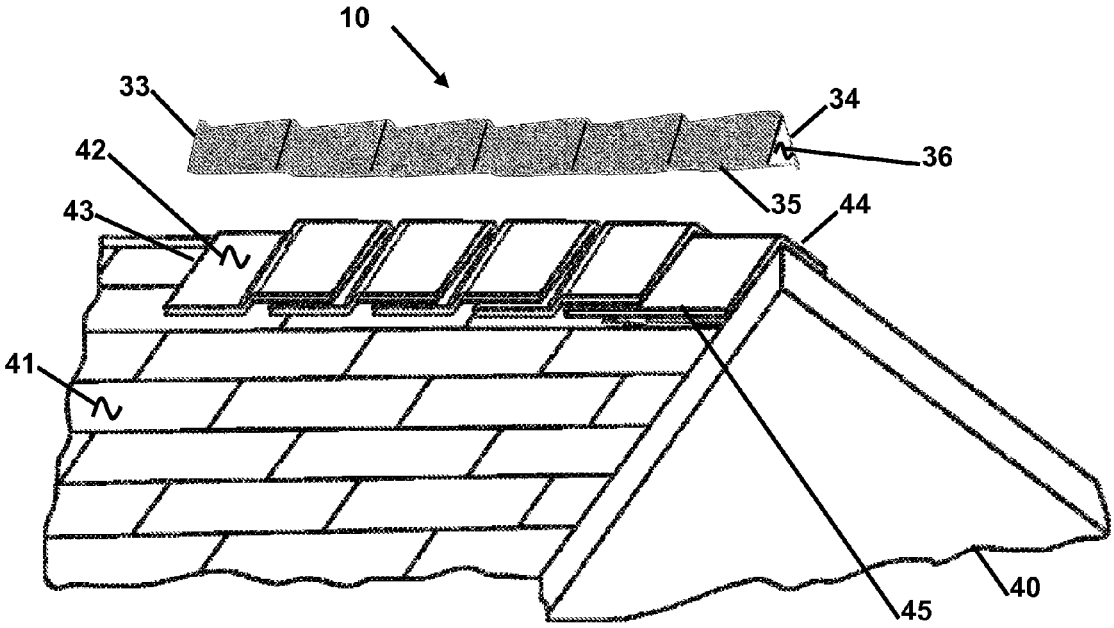
FIG. 3 shows a perspective view of a roof ridge cover positioned over a roof.

FIG. 3 shows a perspective view of a roof ridge cover 10 positioned over a roof. The roof of a house 40 is typically constructed with a peak where the two slopes sides of the roof 41 join. Ridge of the roof is most susceptible to leaks because it often receives the greatest exposure to the sun and elements. The roof ridge cover 10 can be installed in newly installed roofs as a roof ridge cover 10, or can be installed over the top of pre-existing roof ridge shingles 42. When the roof ridge cover 10 is installed on a pre-existing roof ridge shingle 42, the under surface 36 contacts the opposing sloped sides of the pre-existing roof shingle 42. The leading edge 34 wraps over and on the sides 35 of the pre-existing roof ridge single 42 leading edge 44 and side(s) 45. The roof ridge cover 10, has a second rounded edge 33 that wraps around at least partially wrap around at least one pre-existing roof ridge shingle 43 of the existing roof ridge of the pre-existing shingle 42. When the roof ridge cover 10 is installed on the ridge, the leading edge 34 is installed over the outer edge of the ridge to enable water to drop over the edge of the roof. The trailing or upturned edge 33 will be covered by the next roof ridge cover 10. Upon installation of the roof ridge cover 10 the elongated sides of the roof ridge cover 10 are nailed down to prevent the roof ridge cover 10 from being lifted by winds and to retain underlying shingles.

Figure 4:
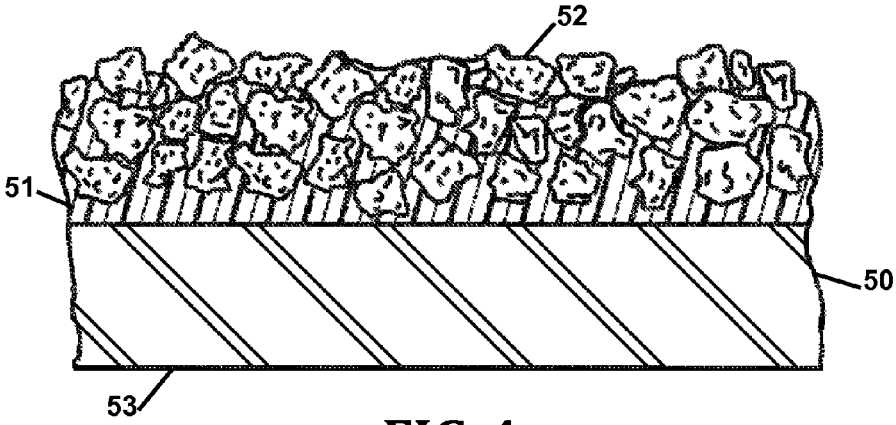
FIG. 4 shows a cross sectional view of the construction of the roof ridge cover.

FIG. 4 shows a cross sectional view of the construction of the roof ridge cover. The roof ridge cover is constructed with an initial base material 50. In the preferred embodiment the base material 50 is steel, but other materials including but not limited to aluminum, copper or tin. The base material 50 is then formed to simulate shingles. The forming process can take place in a progressive arrangement where each tile structure, elevation or relief is formed individually or collectively. It is also contemplated that the base metal 50 is first bent along its length to form the inverted "V" ridge and then in a secondary or subsequent operation(s) then each tile structure, elevation or relief is formed individually or collectively. While the figures show the cover as an inverted "V" it is also contemplated that the cover is configurable for installation on hips, gables and rakes as well as 90 degree "L" shapes. A bonding agent 51 is then applied to the base metal 50 to support a top stone 52 coat that matches the color, density and texture of the roof shingles placed on the roof of a house or structure. The stone coating is typically between the size of sand to pea gravel depending upon the desired appearance and or the appearance of an existing roof material. The bonding agent is typically a nontoxic, non-flammable, re-emulsifying bonding agent that provides a chemical bond between the base material 50 and the top stone(s) 52. A surface treatment of galvanizing 53 or other corrosion prevention can be placed on the base metal 50 prior to applying the top treatments or after the top treatments based upon the manufacturing process. The cover is not affected by climate nor has climate restrictions for installation.

Figure 5:
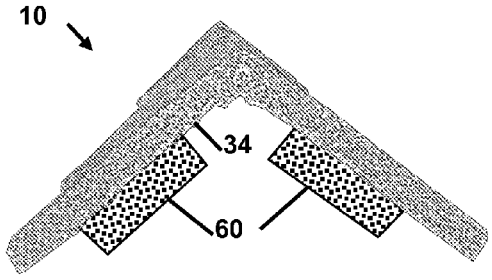
FIG. 5 shows a front view of the roof ridge cover with vent material installed.
Figure 6:
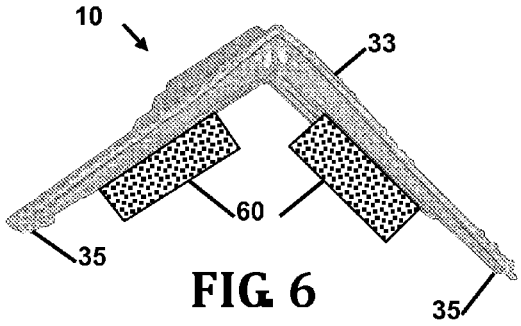
FIG. 6 shows a back view of the roof ridge cover with vent material installed.
Figure 7:
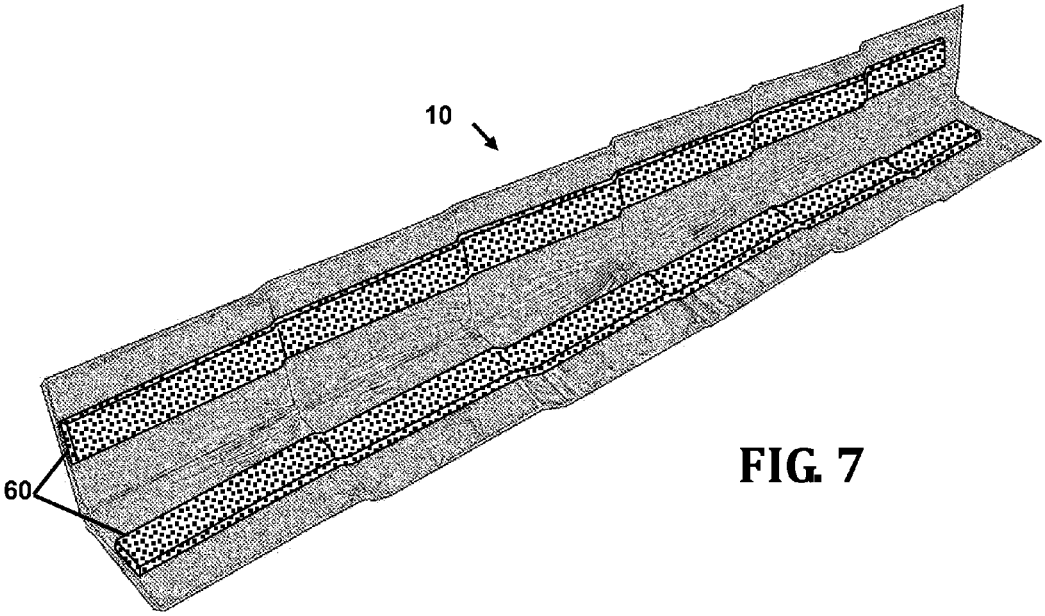
FIG. 7 shows an inside perspective view of the roof ridge cover with vent material installed.

FIG. 5 shows a front view of the roof ridge cover 10 with vent material installed, FIG. 6 shows a back view of the roof ridge cover 10 with vent material installed, and FIG. 7 shows an inside perspective view of the roof ridge cover with vent material installed. The roof ridge cover 10 can be constructed with vent material 60. The vent material 60 is glued, bonded or simply placed under the roof ridge cover 10 upon installation of the roof ridge cover 10. From FIG. 7 the vent material 60 is placed at the front edge of the leading edge 34 of the roof ridge cover 10, while the vent material 60 is set back from the trailing edge 33 to prevent stacking of the vent material 60. The vent material is installed in elongated strips to minimize interference with other roof features that can exist under the roof ridge cover 10. The density of the vent material allows for the attic to breathe and vent air without allowing bugs and insects from entering into the attic. From FIGS. 5 and 6 the outer edges 35 of the roof ridge cover 10 are shown slightly curved.

Figure 8:
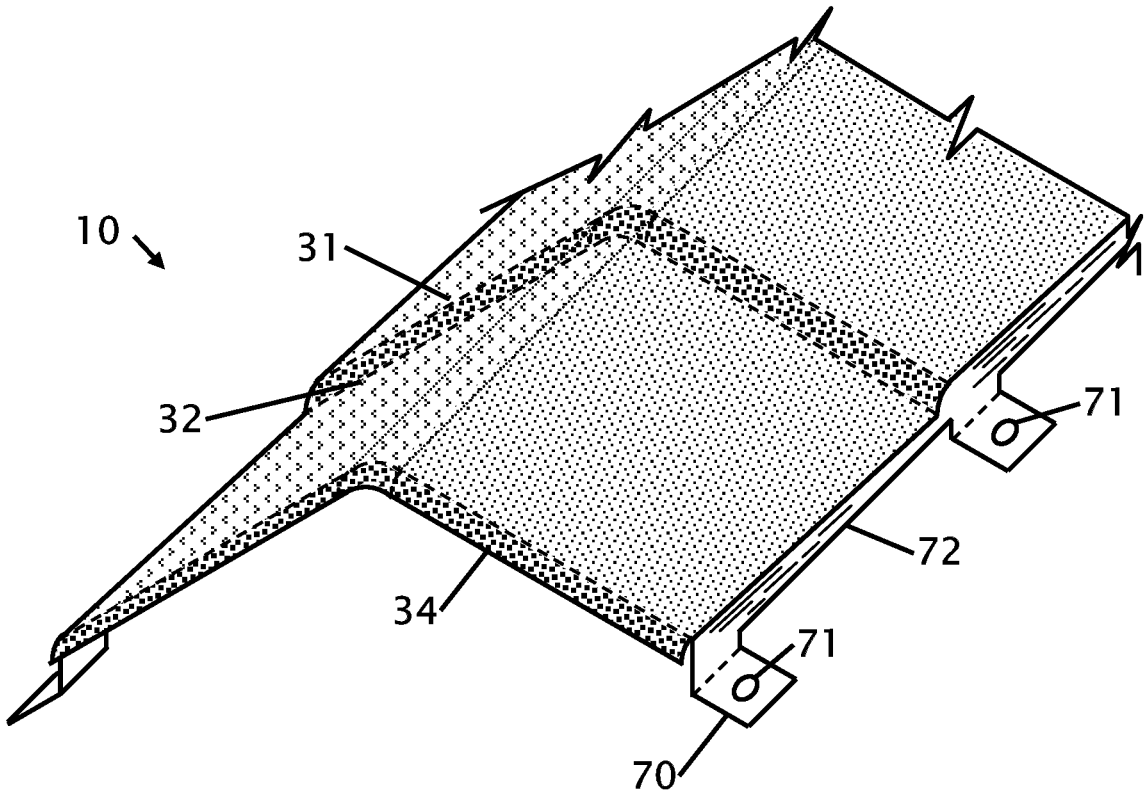
FIG. 8 shows a perspective view of a section of roof ridge cover with tabs for securing the roof ridge cover.

FIG. 8 shows a perspective view of a section of roof ridge cover 10 with tabs for securing the roof ridge cover. The front edge 34 is shown bent over to cover and existing shingle or a previously set roof ridge cover. The rounds 31 and fillets 32 are shown and exist at an interval of approximately 8 inches. Nailing tabs 70 are shown with holes 71 or indentations where nails can be placed through the flanges 70. An air gap 72 is constructed into the roof ridge cover 10 to allow for the passage of air from under the roof. When the tabs 70 are included in the roof ridge cover 10 the bland size must be expanded from 12 inches to approximately 14.5 inches.

Thus, specific embodiments of a roof ridge cover have been disclosed. It should be apparent, however, to those skilled in the art that many more modifications besides those described are possible without departing from the inventive concepts herein. The inventive subject matter, therefore, is not to be restricted except in the spirit of the appended claims.

The invention claimed is:

1. A roof ridge cover comprising:

an elongated base metal formed to give an appearance of multiple ridge cover shingles having an outer surface and an under surface;

a roof having an existing roof ridge with at least a first layer of pre-existing roof ridge shingles;

said base metal is formed in an inverted "V" along said elongated base metal to approximate an angle of the existing roof ridge with the elongated base metal formed with the appearance of multiple ridge cover shingles with at least two generally planar parallel shingle surfaces and a step surface existing between said at least two generally planar parallel shingle surfaces existing on both sides of said inverted "V";

said outer surface of said inverted "V" is a cosmetic surface and said under surface is used to contact with opposing sloped sides of said pre-existing roof ridge shingles;

said elongated base metal being made with at least two rounded corners formed between said at least two generally planar parallel shingle surfaces and said step surface and at least one rounded edge that forms a leading edge of said elongated base metal that wraps over at least one edge of said pre-existing roof ridge shingles;

said elongated base metal further has a coating to give the appearance of multiple ridge cover shingles;

said leading edge at least partially wraps over at least one edge of and on the sides of an elevated shingle edge of the pre-existing roof ridge shingles, and said elongated base metal has a second rounded edge that forms a trailing edge that is rounded to at least partially wrap around at least one pre-existing roof ridge shingle of the existing roof ridge.

2. The roof ridge cover according to claim 1 wherein said coating is a stone coating on said outer surface.

3. The roof ridge cover according to claim 1 wherein said at least two rounded corners are formed with a radius from between 0.12 and 1.0 inch radius.

4. The roof ridge cover according to claim 1 further including at least one venting pad placed on said under surface.

5. The roof ridge cover according to claim 1 wherein said leading edge is rounded to cover at least a portion of a second shingle of the pre-existing roof ridge shingles.

6. The roof ridge cover according to claim 1 wherein said roof ridge cover further includes two elongated sides projecting from a distal edge of said at least two generally planar parallel shingle surfaces formed in said both sides of said elongated base metal having at least two separate tabs, said at least two tabs extending beyond said at least two generally planar parallel shingle surfaces formed in said both sides of said elongated base metal to elevate an underside of said elongated base metal above said pre-existing roof ridge reef shingles.

7. The roof ridge cover according to claim 6 wherein said at least two tabs provide a space for a venting pad.

8. The roof ridge cover according to claim 1 wherein said elongated base metal is selected from a group consisting of steel, stainless steel, aluminum, brass and copper.

9. The roof ridge cover according to claim 1 wherein each of said appearance of multiple roof shingles is formed as single shingles formed in said elongated base metal.

10. The roof ridge cover according to claim 1 wherein each of said appearance of multiple roof shingles are formed in a single forming process.

11. The roof ridge cover according to claim 1 wherein said elongated base metal is galvanized.

12. The roof ridge cover according to claim 1 wherein said elongated base metal is coated to protect from corrosion.

13. The roof ridge cover according to claim 1 wherein said appearance of multiple roof cover shingles is formed with multiple steps wherein each step is between 7 and 12 inches.

14. The roof ridge cover according to claim 1 wherein said elongated base metal is initially a width of between 12 and 14.5 inches.

15. The roof ridge cover according to claim 1 wherein said coating is a nontoxic, non-flammable, re-emulsifying bonding agent.

16. The roof ridge cover according to claim 1 wherein said coating is a stone coating comprising sand or pea gravel.

17. The roof ridge cover according to claim 1 wherein there are at least four generally planar parallel shingle surfaces and at least three separate step surfaces existing between said at least four essentially planar parallel shingle surfaces existing on both sides of said inverted "V".

* * * * *